United States Patent [19]

Kanamoto et al.

[11] 4,220,334

[45] Sep. 2, 1980

[54] SEPARABLE TYPE ELASTIC FINGER REHABILITATION DEVICE

[75] Inventors: Sakumi Kanamoto, Osaka; Hiroshi Ogisawa, Takatsukishi; Akio Ishida, Osaka, all of Japan

[73] Assignee: Maruho Co., Ltd., Osaka, Japan

[21] Appl. No.: 917,887

[22] Filed: Jun. 22, 1978

[30] Foreign Application Priority Data

Jun. 27, 1977 [JP] Japan ..... 52-85873[U]

[51] Int. Cl.[3] ..... A63B 23/00

[52] U.S. Cl. ..... 272/67; 128/26

[58] Field of Search ..... 272/67, 68, 140; 128/26; 84/465, 467, 468

[56] References Cited

U.S. PATENT DOCUMENTS

| | | | |
|---|---|---|---|
| 272,951 | 2/1883 | Gardner | 272/67 |
| 708,242 | 9/1902 | Mosely | 84/467 |
| 2,108,236 | 2/1938 | Scott | 272/67 |
| 3,347,547 | 10/1967 | Hynes | 272/67 |
| 3,814,419 | 6/1974 | Bjorklund | 272/140 |

FOREIGN PATENT DOCUMENTS

| | | | |
|---|---|---|---|
| 61087 | 5/1948 | Netherlands | 272/67 |
| 107386 | 7/1917 | United Kingdom | 272/67 |

*Primary Examiner*—Richard J. Johnson

*Attorney, Agent, or Firm*—Darby & Darby

[57] ABSTRACT

This invention relates to a finger rehabilitation device used in surgical therapy etc., for the purpose of restoring the muscular strength of fingers after therapy and more particularly it relates to a construction of a separable type elastic finger rehabilitation device adapted to gradually increase an unti-bending pressure on the finger according as the finger function is restored, so as to insure rapid restoration of the muscular strength.

12 Claims, 3 Drawing Figures

SEPARABLE TYPE ELASTIC FINGER REHABILITATION DEVICE

BACKGROUND OF THE INVENTION

Generally, the surgical therapy of the hand is followed by the use of a finger rehabilitation device provided with a spring member biased to resist the bending of the finger in order to examine the restoration of the muscular strength of the fingers or for training purposes. Such finger rehabilitation device is designed to be mounted on a finger to be examined or trained so that the muscular strength of the finger can be restored while the finger is repeatedly stretched and bent with the device mounted thereon. Further, it is desired that said finger rehabilitation device be arranged so that an unti-bending pressure exerted thereby on the finger can be gradually increased from a stage immediately after therapy where the muscular strength is very weak, according as the finger function is restored.

SUMMARY OF THE INVENTION

An object of this invention is to provice a separable type finger rehabilitation device having spring members which are arranged so that they can be exchanged at any time by a very simple operation in order to meet the demand described above.

Another object of this invention is to provide a separable type elastic finger rehabilitation device which is simple in construction and which is rugged and light in weight.

More specifically, in order to achieve the above objects, this invention provides a separable type elastic finger rehabilitation device, comprising a finger base engaging member, a finger tip engaging member, and a pair of spring members secured to one of said two members and biased to resist the bending of the finger, wherein removable engaging means is provided between the free ends of said spring members and the other of said two members for making them separable.

BRIEF DESCRIPTION OF THE DRAWINGS

The drawing show a concrete example of the separable type elastic finger rehabilitation device according to this invention.

DETAILED DESCRIPTION OF THE PREFERRED EMBODIMENTS

Figure 1:
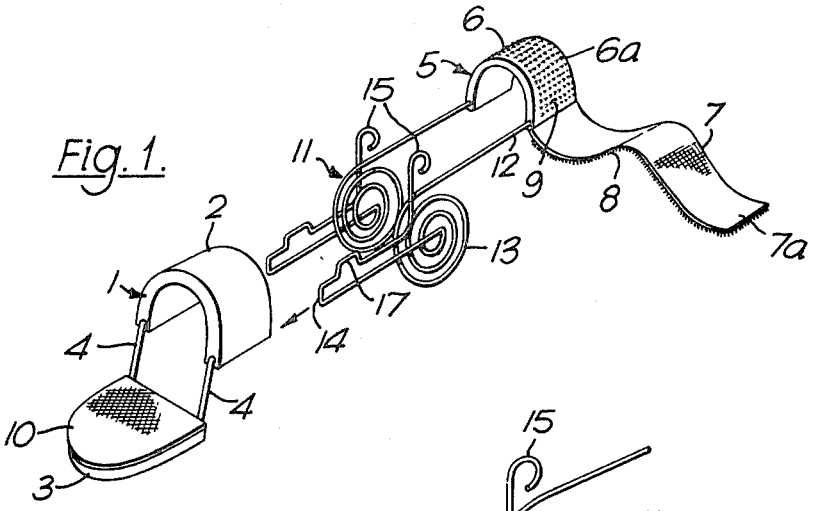
FIG. 1 is a perspective view showing said device in its separated condition.
Figure 2:
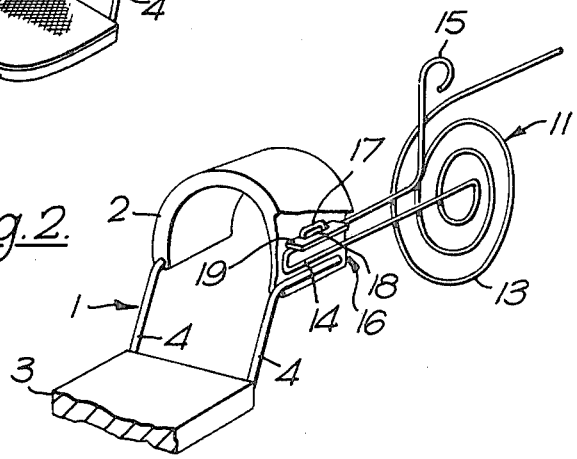
FIG. 2 is a perspective view, partly broken away, showing the construction of removable engaging means.

The construction of the separable type elastic finger rehabilitation device according to this invention will now be described with reference to a concrete example thereof illustrated in the drawing.

Figure 3:
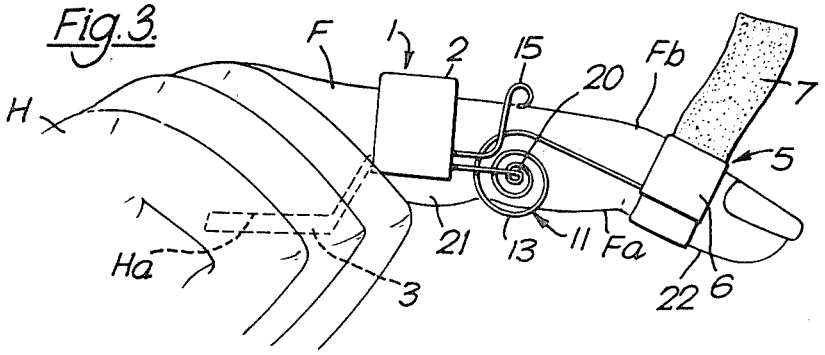
FIG. 3 is a perspective view showing said device assembled and mounted on a finger.

In the drawing, a finger base engaging member 1 comprises a bight element 2 adapted to engage with the back side Fb of a finger F, an abutment element 3 adapted to be applied to the palm Ha, and connecting bars 4 which connect them together, and in use, generally, it is mounted in such a manner that the bight element 2 engages with the base of the finger while the abutment element 3 is applied to the palm. On the other hand, 5 designates a finger tip engaging member. This finger tip engaging member 5 comprises a bight element 6 adapted to engage with the outer surface Fb of the finger F and a tape element 7 for supporting the inner surface Fa of the finger. The tape element 7 is secured to one end of said bight element 6. Further, the free end **7*a* of said tape element 7 is adapted to be connected to the curved surface 6*a* of said bight element 6. As the means for this connection, velvet type fastener components 8 and 9 are provided between said tape element 7 and the curved surface 6*a* of the bight element 6. The bight elements 2 and 6 are made of plastic or leather. If they are made of metal or plastic, linings of cloth or felt will be applied to their inner surfaces. Also, cloth or felt 10 is applied to the surface of the abutment element 3 of the finger base engaging member 1. The spring members 11 are constituted by a pair of spiral spring members formed in the illustrated manner. According to the example shown in the drawing, such spring member 11 comprises, in integrated relation, a fixed portion 12 fixed to the finger tip engaging member 5, a spiral spring portion 13, a connecting end 14 adapted to be connected by engagement to the bight element 2 of the finger base engaging member 1, and a press lever 15 for controlling such engagement connection. Designated at 16 is an example of removable engaging means. This removable engaging means 16 comprises a projection 17 on the free end 14 of the spring member 11 adapted to rise and fall by the operation of said press lever 15, and a lock plate 19 which is provided on the bight element 2 of the finger base engaging member 1 and which has a hole 18 with which said projection 17 engages. The removable engaging means 16, preferably, has a construction of so-called snapping engagement as described above. The spring members 11 are formed of a corrosion- and chemical-resistant material, such as stainless steel wires. Further, by using steel wires of different diameters or varying the number of convolutions of the spiral, said spring members 11 are formed as several kinds of members having different values of spring force. The elastic finger rehabilitation device according to this invention is constructed so that when it is assembled and mounted on a finger, the spring portions 13 of said spring members will be positioned on the PIP joint 20 of the finger. As shown in FIG. 3, in this case, the finger base engaging member 1 is mounted on the corresponding portion of the proximal bone area 21 of the finger while the finger tip engaging member 5 is mounted on the corresponding portion of the distal bone area 22** of the finger.

With the separable type elastic finger rehabilitation device of this invention constructed in the manner described above, the design for removable mounting of the finger tip engaging member 5 including the spring members 11, coupled with the preparation of several kinds of spring members having different values of spring force, makes it possible to assemble rehabilitation devices very easily which agree with the different stages of recovery of the function of the finger. Therefore, it may be said that this invention is suitable for use as a finger rehabilitation device for restoring the muscular strength of fingers which can be adjusted by the patient himself. Further, as is obvious from the arrangement of the finger base engaging member 1 and finger tip engaging member 5, the device is a highly versatile rehabilitation device in that it can be securely mounted on any desired finger irrespectively of the thickness of the finger.

What is claimed is:

1. A separable type finger rehabilitation device comprising:

a first member adapted to engage with the portion of a finger adjacent the base thereof;

a second member adapted to engage with the portion of the finger adjacent the tip thereof; and a pair of spring members adapted to be disposed on the opposite sides of the finger, means for securing said spring members at their one ends to one of said first and second members and for detachably connecting their other ends to the other of said members, each said spring member being a spiral spring and formed to provide a force to resiliently oppose the bending action of the finger to which the device is attached, with the force increasing as the finger is bent further, said securing means further comprising each said spiral spring having a first extension extending in one direction from the outer end of said spiral spring portion and being fixedly connected to said second member and a second extension extending in the opposite direction from the inner end of said spiral spring portion and having a connecting end adapted to be detachably connected to said first member.

2. A finger rehabilitation device as defined in claim 1 wherein said first member comprises a bight element for engaging the outer surface of the finger and an abutment element adapted to be applied to the palm, and a pair of bars for connecting said bight element to said connecting element.

3. A finger rehabilitation device as defined in claim 2 wherein said bight element is of plastic material.

4. A finger rehabilitation device as defined in claim 2 wherein said bight element is covered with a soft material at least in the area to be brought into contact with the base of the finger.

5. A finger rehabilitation device as defined in claim 2 wherein said abutment element is covered with a soft material at least in the area to be brought into contact with the palm.

6. A finger rehabilitation device as defined in claim 1 wherein said second member comprises a bight element for engaging the outer surface of the finger adjacent to its tip and means for removably fastening said bight element to said finger.

7. A finger rehabilitation device as defined in claim 6 wherein said bight element is of plastic material.

8. A finger rehabilitation device as defined in claim 6 wherein said bight element is covered with a soft material at least in the area to be brought into contact with the tip of the finger.

9. A finger rehabilitation device as defined in claim 6 wherein said fastening means comprises a VELCRO type fastener.

10. A finger rehabilitation device as in claim 1 wherein said securing means comprises wire members which leave the major portion of the finger exposed.

11. A finger rehabilitation device as defined in claim 10 wherein each said spring member further including a release member for disengaging the connection between said connecting end and said first member.

12. A finger rehabilitation device as defined in claim 10 wherein said connecting end of the spring member has a hook adapted for engagement with a cooperating notch formed in said first member.

* * * * *